428-408 SR
12/22/87 XR 4,714,649

United States Patent [19]
Edwards

[11] Patent Number: 4,714,649
[45] Date of Patent: Dec. 22, 1987

[54] CARBONIZABLE FABRICS OF ACTIVATED, CARBONIZED FIBERS AND DIFFERENTLY ACTIVATED OR UNACTIVATED FIBERS

[75] Inventor: William Edwards, Runcorn, England

[73] Assignee: C.C. Developments, Limited, London, England

[21] Appl. No.: 681,384

[22] Filed: Dec. 13, 1984

[30] Foreign Application Priority Data

Dec. 29, 1983 [GB] United Kingdom ..... 8334560

[51] Int. Cl.[4] ..... B32B 7/00
[52] U.S. Cl. ..... 428/257; 428/259; 428/408
[58] Field of Search ..... 428/257, 259, 408

[56] References Cited

U.S. PATENT DOCUMENTS 4,251,589 2/1981 Romaniec ..... 428/263
4,303,724 12/1981 Sergeant ..... 428/259

FOREIGN PATENT DOCUMENTS 2933926 3/1981 Fed. Rep. of Germany .
3000854 7/1981 Fed. Rep. of Germany .
3037582 5/1982 Fed. Rep. of Germany .
1370272 7/1964 France .
1259829 1/1972 United Kingdom .
1375486 11/1974 United Kingdom .
1593246 7/1975 United Kingdom .
1444478 7/1976 United Kingdom .
1481211 7/1977 United Kingdom .

*Primary Examiner*—Marion C. McCamish
*Attorney, Agent, or Firm*—Oblon, Fisher, Spivak, McClelland & Maier

[57] ABSTRACT

A carbonizable fabric comprises first carbonizing fibre which can be activated and second fibre which is differently activatable or unaffected by treatment under activation conditions for said first fibre. Stronger, broader absorption spectrum fabrics can be prepared.

16 Claims, No Drawings

CARBONIZABLE FABRICS OF ACTIVATED, CARBONIZED FIBERS AND DIFFERENTLY ACTIVATED OR UNACTIVATED FIBERS

BACKGROUND OF THE INVENTION

This invention relates to activated carbon fabrics.

Carbon fabrics are conventionally made from cellulose fibres or from polyacrylonitrile fibres or from pitch-based fibres. Cellulose fibres are commonly used where activated fabrics are required, though the process of activation, which involves heating for more or less extended periods at elevated temperatures, causes substantial loss of strength. Various impregnants such as Lewis acids or phosphorous compounds have been used to reduce the loss of strength somewhat. Nevertheless, activated carbonised cellulosic fibres are commonly used in composite structures such as laminated or quilted fabrics or in wrapped e.g. cotton-wrapped yarns, or knitted or woven together with supporting yarns, principally on account of their low strength.

Precursor fibres derived from polyacrylonitriles, however, are not, or not so readily, activatable under conditions for activating cellulose based fibres. Heating at the same elevated temperatures and for similar periods as are required for the activation of cellulose-based fibres does not adversely affect the strength of the acrylonitrile-based fibres to the same extent.

Because, particularly, of the lack of strength of cellulose based activated carbonised fibres, it is much preferred that, rather than fabricate fabrics from carbonised yarn or fibre the uncarbonised yarn or fibre is first fabricated and then carbonised in fabric form. Even so, however, higher levels of activation, where the fibre is capable of absorbing more molecules, are substantially precluded on account of the considerable loss of strength involved in attaining those higher levels through prolonged elevated temperatures.

BRIEF DESCRIPTION OF THE INVENTION

The present invention provides new activated carbon fabrics which have improved strength and which can on that account be activated to higher levels than hitherto possible without unacceptable loss of strength.

The invention also provides activated carbon fabrics having a broader spectrum of molecular absorption than hitherto.

The invention comprises an activated carbon fabric comprising first carbonising fibre which can be activated and second fibre which is differently activatable or unaffected by treatment under activation conditions for said first fibre.

Said second fibre may be also activated, but relatively inactivated as compared to said first fibre. The two fibres may then between them provide a wider range of absorbtion of molecules than either fibre would alone.

The fabric may comprise at least one strength fibre that maintains strength under activation conditions for said first fibre. Said strength fibre may be activated but differently from the other fibre (or fibres) and will in general be relatively inactivated, so as to have small pore size and be capable of absorbing smaller molecules than the other fibre.

The processes for carbonising cellulose based fibres and acrylonitrile based fibres are essentially different, in particular in regard to the first stage of processing the fibres. Acrylonitrile based fibres need to undergo a first oxidising stage under tension to develop strength. Cellulose fibres, on the other hand, need to be under minimal tension during their initial heating stage, and are in practice carbonised in fabric form. It would be impossible to apply the necessary tension to acrylonitrile based fibres when in fabric form, and thus they are first carbonised, then fabricated.

Said first fibre precursors may be natural or regenerated cellulosic fibres. Where said second fibre precursors are acrylonitrile based, however, according to the invention, they are pre-oxidised. The acrylonitrile based fibre precursors can thus be processed separately from the cellulose based fibre precursors so that they can be oxidised under tension. The pre-oxidised acrylonitrile based fibres and the cellulose based fibre precursors can then be mixed and fabricated into a fabric which can be carbonised and activated to form the fabric of the invention.

A phenolic fibre may also be used as a first precursor fibre.

Said acrylonitrile based fibre precursor may comprise a pre-oxidised homopolymer of acrylonitrile, or a pre-oxidised copolymer of acrylonitrile comprising at least 50% by weight of acrylonitrile before oxidation. Or said second fibre precursor may comprise a mixture of polymers comprising at least 50% by weight of acrylonitrile before oxidation.

Said second fibre may be derived from pitch or from polyacrylonitrile or from cellulose.

Said strength fibre may comprise a non-carbonising fibre, such for example as a ceramic fibre or a metal fibre.

Said first and second fibres may be selected to provide a mix of absorptive properties, and where a strength fibre (of whatever kind) is provided in addition to said first and second differently activated fibres the activated fibres can have substantial levels of activation. Said first and second fibres may then be derived from different natural or regenerated cellulosic fibres for example from cotton and rayon, or from differently doped or impregnated rayons, or phenolics, or from a phenolic and a cotton or rayon, or other combination of the same.

Said first and second fibres may on the other hand, be acrylonitrile-based, or said first fibre may be cellulose and said second fibre acrylonitrile based.

Thus it will be seen that fibres may be regarded as activatable or relatively inactivatable depending upon which other fibres are present and upon what activation conditions are used.

Activation may incidentally comprise a single stage process or a two or more stage process involving different activation conditions. One activation may take place in a carbon dioxide atmosphere, for example, and a second activation in steam. Or two activations may take place at different temperatures.

In addition to the fibre mix and activation conditions, variations in absorption properties of fabrics as well as in other textile properties such as strength may be produced by adopting different fabric constructions and in particular by the way in which the fibres are used together, for example whether the fibre mix is intimate or not.

Said fibre precursors on the one hand may be comprised in a single fabric component, which may comprise a yarn from which the fabric is woven or knitted. Said single component, however, may comprise a fleece, said fabric being non-woven.

Said first and said second fibre precursors may, on the other hand, be comprised in two different fabric components, which may comprise yarns. Said yarns may have different relative quantities of said first and said second fibres—one yarn may, for example, comprise 100% acrylonitrile based fibres while the other comprises 50% acrylonitrile based fibres and 50% cellulose based fibres. Such different yarns can be used as warp and weft in a woven fabric or may be knitted. In knitting, one yarn may be plated on one face of the fabric, while a woven fabric can be so constructed as similarly to place a preponderance of one fibre—say the activatable fibre—on one face.

Otherwise, said first and said second fabric components may comprise fleeces or sections of a single fleece. In this event also it may be arranged to have a preponderance of one of said fibre precursors on one face or otherwise to distribute said fibre precursors through said fabric in a desired manner other than homogeneously.

The pre-oxidation of polyacrylonitrile fibres into said second fibre precursors and the subsequent carbonisation and activation of the fabric may be done in ways which are already known, it merely being necessary if the fabric is to derive its strength from one of said fibres to ensure that carbonisation conditions are suitable for both said first and said second fibre precursors and that in the activation stage the desired degree of activation of said first fibre precursors is brought about without also effecting substantial activation—and hence loss of strength—of said second fibres. The relative amounts of said first and said second fibres present in the fabric will influence the degree of activation that is attained while still retaining adequate fabric strength for any particular purpose.

It is of course possible further to increase the strengths or alter other properties of the fabric by inclusion of other substances such for example as ammonium, sulphur or phosphorus compounds, or salts of heavy metals, either by doping the melt or spinning solution or by impregnation in known manner.

Carbonised and activated fabrics according to the invention will now be described in the following Examples.

EXAMPLE 1

A viscose rayon fibre is blended with a pre-oxidised polyacrylonitrile fibre in the proportion 60:40 by weight, both fibres being of 2 denier and 50 mm staple. A yarn is spun from the blended fibre giving a resultant yarn count of 10's English Cotton Count, this yarn is then folded to give a resultant yarn of 2/10's English Cotton Count. A plain woven fabric is woven from this unsized yarn, having a warp of 10 ends and a weft of 10 picks per cm.

The above fabric is then impregnated with a solution having the following composition:

Urea: 20 parts by weight

Diammonium hydrogen phosphate: 5 parts by weight

Water: 75 parts by weight.

During impregnation the solution is maintained at a temperature of 60° C.; after passing through the solution the fabric is squeezed between pad rollers and then dried at 100°–110° C. After drying the fabric is immediately subjected to flexing so as to ensure separation of the fibres within the fabric otherwise stuck together by the impregnating process. The fabric so treated will contain 18% of solids on a dry weight basis. Subsequently the fabric is heat treated in an air circulation oven at 265° C. for 20 minutes.

The above pre-carbonised fabric is then passed through a horizontal furnace which is kept oxygen free by the continual passage of $CO_2$ from a number of entry points distributed along the furnace, which is heated so as to enable the fabric to be progressively heated to a temperature within the range 800°–900° C. at a rate between 20°–40° C. per minute, and maintained at such temperature for a time period between 15–30 minutes.

The fabric after undergoing such treatment will comprise an active component formed from the viscose rayon fibre and a strengthening component derived from the relatively unchanged pre-oxidised polyacrylonitrile fibres. Tensile strengths are warp 8 kg/cm, weft 6 kg/cm. Adsorption measured by the heat of wetting of benzene is 38 cal/gm.

EXAMPLE 2

A viscose rayon fibre is blended with a pre-oxidised polyacrylonitrile fibre in the proportions 60:40 by weight, both fibres being of 2 denier and 50 mm staple. A yarn is spun from the blended fibres to give a yarn of 22's English Cotton Count.

The yarn is then knitted on a 20 gauge circular knitting machine so as to produce an interlock fabric having 12 wales/cm and 14 courses/cm on the fabric face. The fabric is slit and then impregnated through the solution described in Example 1 and after drying and flexing subjected to the same heat treatments also described in Example 1.

The fabric after undergoing such treatment will be strong, have excellent draping and stretching properties and will possess high adsorption capability.

EXAMPLE 3

A viscose fibre is blended with a pre-oxidised polyacrylonitrile fibre in the proportions 60:40 by weight, both fibres being in the denier range 3–7 and the staple range 50–80 mm. After blending the fibre is needled to form a felt having a weight of 350 grm/m$^2$.

The felt is impregnated through the solution described in Example 1 and after drying and flexing is subjected to the heat treatment also described in Example 1.

The felt after undergoing such treatment will retain much of its original strength and will have considerable adsorption properties.

In the foregoing examples, the impregnating solution can comprise a solution of a Lewis acid as described in British patent 1301 101 and U.S. Pat. No. 3,847,833. Evidently some Lewis acids are more effective than others at maintaining the strength of viscose fibres during activation in that Lewis acids are disclosed in those patents which are said to be effective but for which no monopoly is claimed. Such less effective Lewis acids may nevertheless be found perfectly adequate for use when a strength fibre is blended with the viscose fibre.

EXAMPLE 4

A phenolic fibre is blended with a pre-oxidised polyacrylonitrile fibre in the proportions 60:40 by weight, both fibres being of 2 denier and 50 mm staple. A yarn is spun from the blended fibres to give a resultant 10's English Cotton Count. A plain woven fabric is produced from this yarn having a warp and weft of 10 ends and picks respectively per cm.

The fabric is then passed through a horizontal furnace which is kept oxygen free by the continual passage of $CO_2$ from a variety of entry points controlled so as to ensure optimum conditions within the furnace. The furnace is heated so as to enable the fabric to be progressively heated to a temperature within the range 800°–900° C. at a rate of between 20°–40° C. per minute and maintained at such temperature for a time period between 15–30 minutes.

The fabric having undergone the above treatment will comprise an active component formed from the phenolic fibre and a strengthening component derived from the pre-oxidised polyacrylonitrile fibre. Tensile strengths are warp 5 kg/cm, weft 4.6 kg/cm. Adsorption measured by the heat of wetting of benzene is 42 cal/grm.

EXAMPLE 5

Two rayon fibres one of which incorporates a heavy metal, such as copper may be blended together with a pre-oxidised polyacrylonitrile fibre in the proportion 30:30:40 by weight and yarn and fabric made therefrom and carbonised and activated as described in Example 1 though using activation conditions appropriate to the fibres used. The resulting fabric will have a similar performance so far as strength is concerned to that of the fabric of Example 1, but the range of molecular weights absorbed by the fabric will be extended.

EXAMPLE 6

The rayon fibres of Example 5 are made into a felt without the preoxidised polyacrylonitrile fibre and supported between layers of mesh made of carbon fibre. The composite is impregnated as described in FIG. 1 and subjected to a carbonising and activating process also as described there. For the undoped viscose fibre there may be substituted a polynosic fibre, or a blend may be made from the polynosic and the doped and undoped viscose fibres. In any event the resulting composite will comprise a blend of differently activated fibres which exhibit a broader absorption spectrum than any single fibre and although the strength of the felt may be such as to render it unusable in many circumstances without the support of the carbon fibre mesh it will nevertheless be stronger than a felt similarly processed but made from just the weakest of the resulting fibres.

Where a polyacrylonitrile fibre is referred to in the foregoing examples, it is desirably a homopolymer, or a copolymer comprising at least 50% by weight of acrylonitrile before oxidation, or it may be a mixture of polymers comprising at least 50% by weight of acrylonitrile before oxidation, especially if the acrylonitrile is to be a strength rather than an activated component of the fabric.

Different polyacrylonitrile fibres can be used of which one for example incorporates a salt of a heavy metal introduced as a dope into the melt as in the following example:

EXAMPLE 7

Two pre-oxidised polyacrylonitrile fibres are blended together in a ratio 50:50 by weight, the fibres being of about 2 denier and 50 mm staple length. One fibre is an unadulterated homopolymer of polyacrylonitrile, and the other is also a homopolymer of polyacrylonitrile with an incorporated heavy metal. A folded yarn is made from the blended pre-oxidised fibres similar to the yarn referred to in Example 1 and fabricated also as therein described, the resulting fabric being subjected to activation under harsher conditions than the yarn of Example 1. The result will be a fabric which is substantially stronger than the fabric of Example 1 but which is activated to a lesser extent, depending upon the precise activation conditions used, but which will also have a broader absorption spectrum than a fabric made from a single polyacrylonitrile fibre.

What I claim is:

1. An activated carbon fabric comprising first, activated, carbonised fibre and second, differently activated or unactivated fibre said firsdt and second fibres being derived from diffrent precursors, said second fibre being derived from a fibre preoxidised and formed with the precursor for the first fibre into a fabric which is then subjected to carbonisation and activation treatment.

2. A fabric according to claim 1, in which said second fibre is activated but relatively inactivatable as compared to said first fibre.

3. A fabric according to claim 1, comprising at least one strength fibre that maintains strength under activation conditions for said first fibre.

4. A fabric according to claim 3, in which said strength fibre comprises said second fibre.

5. A fabric according to claim 4, in which said first fibre is derived from natural or regenerated cellulosic fibre or a phenolic fibre.

6. A fabric according to claim 1, in which said second fibre is acrylonitrile-based.

7. A fabric according to claim 6, in which said acrylonitrile-based fibre comprises a pre-oxidised homopolymer or a copolymer or a mixture of polymers of acrylonitrile comprising at least 50% by weight of acrylonitrile before oxidation.

8. A fabric according to claim 1, in which said second fibre is derived from pitch or polyacrylonitrile or cellulose.

9. A fabric according to claim 1, in which a non-carbonising fibre such as a ceramic fibre is used as a strength fibre.

10. A fabric according to claim 1, in which said first and second fibres are selected to provide a mix of absorptive properties.

11. A fabric according to claim 10, in which said first and second fibres are derived from different, natural or regenerated cellulosic fibres.

12. A fabric according to claim 10, in which said first and second fibres are derived from different acrylonitrile-based fibres selected to activate differently under the same activation conditions.

13. A fabric according to claim 10, in which said first carbonising fibre precursor is cellulosic and said second fibre is acrylonitrile-based.

14. A fabric according to claim 1, in which said fibres are comprised in a single fabric component, such as a yarn of a woven or knitted fabric or a yarn or a fleece of a non-woven fabric.

15. A fabric according to claim 1, in which said fibres are comprised in two different fabric components, such as yarns e.g. warp and weft in a woven fabric, or yarns in a knitted fabric.

16. A fabric according to claim 15, in which there is a preponderance of one of said fibres on one face, as by one yarn being plated on one face.

* * * * *